United States Patent [19]

Weiss

[11] Patent Number: 4,729,204

[45] Date of Patent: Mar. 8, 1988

[54] CONTAINER CLOSING MACHINE

[75] Inventor: Wilhelm Weiss, Regensburg, Fed. Rep. of Germany

[73] Assignee: Krones AG Hermann Kronseder Maschinenfabrik, Neutraubling, Fed. Rep. of Germany

[21] Appl. No.: 856,014

[22] Filed: Apr. 25, 1986

[30] Foreign Application Priority Data

Apr. 27, 1985 [DE] Fed. Rep. of Germany ..... 3515334

[51] Int. Cl.[4] ..... B67B 3/00; B65B 7/28

[52] U.S. Cl. ..... 53/88; 53/343; 53/510

[58] Field of Search ..... 53/85, 88, 89, 91, 92, 53/94, 95, 96, 290, 331, 343, 510, 306, 308, 309, 310

[56] References Cited

U.S. PATENT DOCUMENTS

| | | | |
|---|---|---|---|
| 2,131,876 | 10/1938 | Hurst | 53/510 |
| 2,322,250 | 6/1943 | Murch | 53/510 |
| 2,693,305 | 11/1954 | Boyd et al. | 53/510 |
| 2,974,456 | 3/1961 | Parodi | 53/343 |
| 3,246,447 | 4/1966 | Smith et al. | 53/510 |
| 3,545,160 | 12/1970 | Jantze et al. | 53/510 |
| 3,807,133 | 4/1974 | Simonazzi | 53/306 |

FOREIGN PATENT DOCUMENTS 3226172 1/1984 Fed. Rep. of Germany .

*Primary Examiner*—Robert L. Spruill
*Assistant Examiner*—Donald R. Studebaker
*Attorney, Agent, or Firm*—Fuller, Puerner & Hohenfeldt

[57] ABSTRACT

At the upper side of the star wheel bottle feeder of a bottle capping machine, a chamber which encompasses the bottle neck is attached at each pocket in the periphery of the star wheel in which the bottle neck is registered as it is transported in a circular orbit. At the top side, the chamber has an opening for a reciprocating sealing element which revolves with the star wheel. The chamber has a circular internal bore and an opening on its radially outermost side that allows bottles to be passed through it and into a pocket on the star wheel. There is a nozzle slot at the radial inside of the chamber diametrically opposite from the outside gas exit opening. The gas input slot has an elbow connected to it and the elbow is connected to a gas distributor valve which is, in turn, connected to a source of carbon dioxide. Because the neck and mouth of each bottle is captured within the chamber, the opening of the bottle and the underside of the crown cap are purged of air which is replaced with inert gas before the cap is crimped onto the bottle.

9 Claims, 2 Drawing Figures

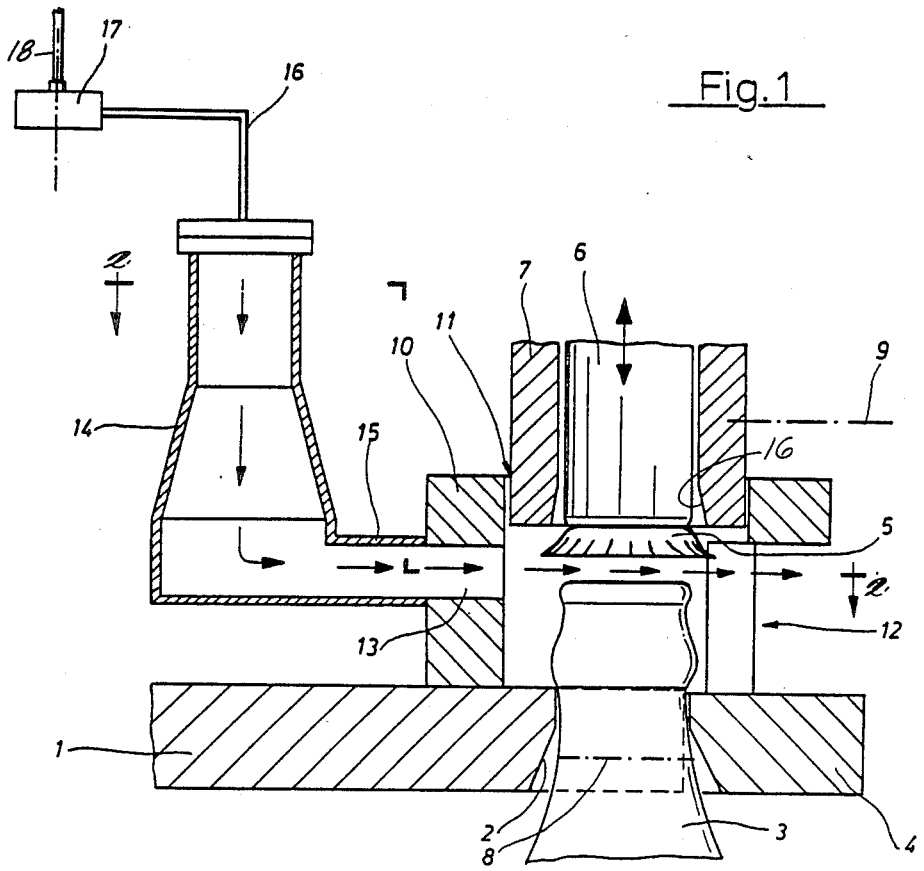
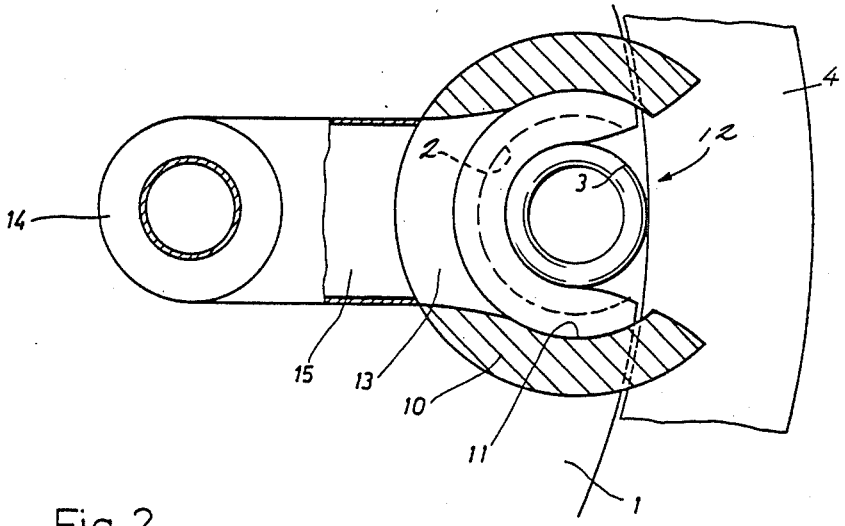
Fig. 2

CONTAINER CLOSING MACHINE

BACKGROUND OF THE INVENTION

The invention disclosed herein relates to machines for applying closures to containers such as bottles and, particularly, to a device for filling the necks of the bottles with inert gas in the free space above the liquid level before the closure is applied.

In machines for filling and applying closures to bottles containing a liquid, such as beer, which is sensitive to oxygen, it is necessary to purge the air from the necks of the bottle and replace the air with a non-oxidizing gas such as carbon dioxide. A variety of devices for supplanting the air above the liquid level in a container with inert gas are known. Most of the devices use nozzles that project carbon dioxide into the bottle through its mouth and into the space above the neck of the bottle and the descending enclosure applying ram.

German Patent No. DE32 26 172 discloses a procedure for replacing the air in the neck of nearly filled bottles with inert gas. In the patented machine, warm inert gas is first introduced into the bottle neck to dissolve or suppress bubbles which may have remained inside at the top of the liquid. Subsequently, inert gas is injected directly toward the mouth of the bottle by means of nozzles in order to eliminate the air contained in the neck and to substitute the inert gas. After the inert gas is injected, crown caps are advanced on a magnetic holder and pressed onto the bottle mouth with a cylindrical head that has a tapered or bell-shaped hole that crimps the caps. The nozzles are attached to the vertically reciprocating head that presses the cap onto the bottle.

With the known device, the bell-shaped opening on the capping head must encompass the bottle mouth before creating an inert gas ambient for exclusion of air can be assured. Thus, only a short time is allowed for the nozzle to expel the air from the empty space in the bottle neck, from the hollow space in the sealing cap and from the space between the bottle opening and sealing cap. The time between entry of the bottle in the bell-shaped capping head and application of the closure cap is so short that purging of air in the spaces mentioned is incomplete by this method. Furthermore, introduction of the sealing caps under the sealing cone is difficult since this must be done through a lateral opening in the bell-shaped head.

In German Patent No. DE-AS 19 10 548, bottles filled with liquid that degrades by exposure to oxygen are first completely filled in a carbon dioxide atmosphere and, before applying the caps, liquid is displaced from the bottle by carbon dioxide. In this patent, the bottles are filled to the rim with liquid and are moved under the sealing device. During lowering of the sealing head, high pressure carbon dioxide is blown from below and lateral to the bottle opening, against the sealing cap and the bottle is sealed during continuous injection of carbon dioxide. In this arrangement, immediately before sealing, carbon dioxide is blown under high pressure by means of nozzles, which are arranged below a bottle centering bell, and against the bottom side of the crown cap so that the gas deflects off the cap and against the liquid surface in the bottle. As a result of the carbon dioxide being blown in, part of the liquid is displaced from the bottle opening so that an empty space is created which is supposedly filled with pure carbon dioxide.

One disadvantage of the known procedure just described is that, due to the impact of carbon dioxide deflected off of the inner side or bottom side of the crown cap, the displacement or overflow of an unpredictable amount of contents of the bottle must be tolerated. Besides, in the bottle neck a complete displacement of air by carbon dioxide cannot be assured. Using the bottom side of a crown cap as a gas stream deflecting surface does not result in the desired efficiency of air displacement by carbon dioxide emitted from nozzles which must be arranged relatively far below the bottle mouth or opening.

SUMMARY OF THE INVENTION

In a bottle capping machine according to the invention, a bottle is brought into capping position wherein its mouth or top opening is surrounded by a rather closely fitting chamber. An inert gas flow is directed radially toward the bottle to a discharge opening. Since the gas flow path is defined, the flow cannot be disturbed by ambient air. Admission of the inert gas can begin as soon as the mouth of the bottle enters the chamber, that is, before the sealing element which applies the cap is lowered. The effective time for performing the air purging and inert gas replacement steps is appropriately long. Because of the arrangement of the input and output ports in the chamber and the timing relationships, the containers can be sealed in an absolute oxygen-free atmosphere.

A more detailed description of the new device for purging air from the necks of bottles, filling the neck above the fluid level with inert gas, introducing a cap at a time into the capping chamber and pressing the cap onto the bottle will now be described in greater detail in reference to the drawing.

DESCRIPTION OF THE DRAWING

FIG. 1 is a partial vertical section of the device in a bottle closing machine for filling the space above the liquid in a bottle with inert gas and for applying a closure to the bottle; and FIG. 2 is a transverse section taken on a line corresponding with 2—2 in FIG. 1.

DESCRIPTION OF A PREFERRED EMBODIMENT

Although the principles of the invention disclosed herein can be applied in machines for filling the space above the liquid level in containers of various types with inert gas and applying a cap to the container, the invention will be illustrated herein in connection with gas purging, filling and capping of containers in the form of bottles.

In accordance with conventional practice, in the machine depicted in FIGS. 1 and 2, bottles 3 are transported in a circular path to and through a bottle capping station. The transport device, commonly known as a feeder star, basically is comprised of two coaxially arranged circular plates which rotate together about a common vertical axis and which have notches or pockets in their periphery for engaging bottles and moving them in and out of the capping station. In FIG. 1, only the upper plate of the feeder star is shown and it is given the reference numeral 1. The pockets 2 are distributed equally about the circumference of the circular plates or wheels 1. The bottles 3 are caused to enter into the pockets 2 after they are filled with fluid up to a predetermined level such as the level designated by the dash-dot line marked 8. It is assumed that the liquid in the bottles 3 is one that may be harmed by the oxygen in air. Beer is an example of such liquid. Typically, the bottles coming from the filling machine, not shown, are engaged by a transfer star wheel, not shown, from which the bottles are taken by the feeder star wheel 1 and are then held in the pockets by guide sectors 4 which are stationary and are arranged around almost the entire orbital path of the bottle. The inside edge of the guide sector 4 is shaped similarly to the outside edge of the star wheel 1 so that the complementarily shaped edges define a cone-shaped pocket 2.

The sealing devices themselves orbit with the bottles 3 and the star wheel 1. The sealing device is a head comprised of a vertical reciprocable cylindrical sleeve 7 in which there is a bore occupied by a magnetic plunger 6. At its lower end, the bore is flared radially outwardly as indicated at 16. A crown cap 5 is presently magnetically attracted to the magnetic plunger or holder 6. When the sealing device elements 6 and 7 are driven downwardly by means which are conventional and not shown, crown cap 5 is pressed onto the upper lip of the mouth of bottle 3 and the conical or flared end 16 on cylindrical sleeve 7 moves down to perform a wiping action along the sides of the crown cap to thereby crimp the cap onto the bottle. A cap at a time is put in position to be held by magnetic plunger 6 when the plunger 6 and sleeve 7 are retracted upwardly to the level of dash-dot line 9. The caps 5 are brought in position under the magnetic holder 6 when it and cylinder 7 are retracted by means of a small star wheel which is not shown.

On the upper side of the upper star wheel plate 1, at each star pocket 2, a chamber 10 is fastened so the chamber revolves with the star wheel. The chamber is circular interiorly and has an inner bore into which the sealing device elements 6 and 7 can enter. As shown in FIG. 1, there is small clearance gap 11 between the inside of chamber 10 and the outside periphery of sealing sleeve 7 so the sleeve can move freely into and out of chamber 10 but without substantial leakage of inert gas through the gap. The wall of chamber 10 has an opening 12 on its radially outermost side. The opening is large enough for the heads of bottles to enter and exit unobstructed. As shown in FIG. 2, there is a very small gap between the periphery of transport star wheel 1 and stationary guide sector 4 so that chamber 10 is mostly closed off towards the underside when a bottle 3 occupies the star pocket 2 as indicated by dot-dash lines.

At the radially inward side of each separate chamber 10 a horizontally extending nozzle slot 13 is formed in the chamber wall at the height of the opening or mouth of the bottle 3. Coupled to nozzle slot 13 is an elbow member 14 which has a horizontal slit nozzle 15 formed on it. The cross sectional configuration of nozzle 15 corresponds to the cross section of slot 13 in the chamber 10. Elbow 14 is supplied with inert gas, such as carbon dioxide, through a flexible hose schematically indicated by line 16 which leads from a rotary valve distributor 17. Valve 17 is supplied with gas from a source, not shown, by way of a gas hose 18. The rotary valve distributor 17 is located concentric to the rotational axis of the star wheel 1 and supplies carbon dioxide to each elbow 14 through a specific part of the circular path of the elbow, starting shortly before the entry of a bottle head into the respective chamber 10 and finishing after the complete placement of a crown cork cap 5 on bottle 3.

The function of the above described container closing machine is as follows. At the outset, it is assumed that the bottles 3 have been filled with a liquid such as beer up to the desired level in a bottle filling machine that is not shown. The bottle is filled to the level indicated by the dash-dot line 8. At the time of filling, the space above liquid level 8 is filled with pure or almost pure carbon dioxide. The bottle filling machine and the closing machine are generally arranged next to each other so that during transport of bottles between them atmospheric oxygen will not invade the neck of the bottle down to its contents. In the worst case, a portion of the pure carbon dioxide is mixed somewhat with air in the area of the bottle opening. In this condition, the bottles 3 enter into the transport star wheel 1 of the container closing machine. Then carbon dioxide is admitted under sufficient pressure above atmospheric from rotary disk valve 17 through line 16 and elbow 14 for exiting into the chamber 10 through slot 13.

The carbon dioxide emerging in a broad current from the nozzle slot 13 fills the interior of chamber 10 completely and flows into the atmosphere through the discharge opening 12 in chamber 10. Hence, the bottle opening or the bottle head is completely shielded against ambient air and air having possibly entered the bottle is displaced and replaced by carbon dioxide.

The carbon dioxide is caused to start flowing into the chamber 10 before the clindrical sealing cone 7 has started its downward movement into the opening 11 of the chamber 10. Hence, the bottom side of the magnetic cap holding device 6 can, in an unobstructed manner, be admitted with a crown cap 5. A portion of the carbon dioxide emerging from nozzle slot 13 can, thus first of all, escape through opening 11 in the top of chamber 10. Consequently, this volume is also purged of air with carbon dioxide and thus made airfree. As soon as the sealing element 6 and a magnetically attracted cap 5 on it have entered the top opening 11, the carbon dioxide will then only escape through the lateral opening 12 in chamber 10. At this time, the bottom side of the sealing elements 6 and 7 and the bottom of crown cap 5 are flushed with carbon dioxide and thus are purged of air. As a result, no atmospheric oxygen can be carried over into the bottle.

Due to the inert gas input nozzle slot 13 being diametrically opposite from gas exit opening 12, and due to the top of the bottle being shielded by chamber 10, the bottle opening is impacted by an essentially horizontally directed uniform broad current of carbon dioxide so that any contact of the interior of the bottle with ambient air is prevented. The influence of atmospheric oxygen on the contents of the bottle in the area of the sealing machine is thus completely eliminated.

I claim:

1. A machine for closing containers such as bottles comprising:

star wheel means for being driven rotatably about a vertical axis and including upper and lower wheel members having pockets in which said bottles are held as they are transported in a circular path, a chamber mounted to the top of said upper wheel member at each pocket for being occupied by the neck of a bottle and said chamber having a top opening aligned with said bottle, and bottle sealing means in said top opening movable in parallelism with said vertical axis alternately toward the mouth of said bottle to place and seal a closure element on the mouth and move away from said bottle and out of said chamber sufficiently far to acquire a closure element, said sealing means closing said top opening by said movement toward said mouth shortly after said closure element is acquired, said chamber having a nozzle slot on one side presented toward said vertical axis for projecting a stream of gas through said chamber and having an opening presented away from said axis for admitting the neck of said bottle and for discharging said gas from said chamber, and means for coupling said nozzle slot to a source of non-oxidizing gas.

2. The machine according to claim 1 wherein:

said chamber is a hollow cylinder whose axis is parallel to said vertical axis and said nozzle slot is substantially diametrically opposite of said opening and said cylinder is concentric to the neck of the bottle and has an inside diameter substantially greater than the diameter of said neck.

3. The machine according to any one of claims 1 or 2 wherein said nozzle slot has a width in the circumferential direction about said axis extending over almost the entire interior width of said chamber.

4. The machine according to any one of claims 1 or 2 wherein said means for coupling said nozzle slot to a source of gas includes an elbow member coupled to said nozzle slot and said elbow member has one of its openings aligned with said nozzle slot and said one opening has substantially the same cross-sectional shape as said nozzle slot, a rotary gas distribution valve rotatable about said vertical axis and a tubular element coupling said valve and the other opening of said elbow member.

5. The machine according to claim 3 wherein said means for coupling said nozzle slot to a source of gas includes an elbow member coupled to said nozzle slot and said elbow member has one of its openings aligned with said nozzle slot and said one opening has substantially the same cross-sectional shape as said nozzle slot, a rotary gas distribution valve rotatable about said vertical axis and a tubular element coupling said valve and the other opening of said elbow member.

6. The machine according to any one of claims 1 or 2 wherein said nozzle slot has a vertical height great enough for said slot to extend above and below the mouth of said bottle.

7. The machine according to claim 3 wherein said nozzle slot has a vertical height great enough for said slot to extend above and below the mouth of said bottle.

8. The machine according to any one of claims 1 or 2 including a stationary curved guide sector concentric to said upper wheel member and close to said member for retaining said bottles in said pockets, said sector arranged at substantially the height of said upper wheel member for closing off the bottom of said chamber in conjunction with said bottle.

9. The machine according to any one of claims 1 or 2 wherein said top opening of said chamber is circular and said bottle sealing means comprises a cylindrical sleeve member having an outside diameter almost the same as the diameter of said opening, said sleeve member having an inner bore whose lower end is tapered for crimping a crown cap on the mouth of a bottle, said sealing means also including a magnetic plunger member inside of said sleeve member and reciprocable vertically with said sleeve member in said chamber, said members being withdrawable together a sufficient distance from said chamber to provide clearance for depositing a crown cap on said magnetic member.

* * * * *